United States Patent [19]

Parker et al.

[11] Patent Number: 4,628,294

[45] Date of Patent: Dec. 9, 1986

[54] END CAP ASSEMBLY FOR A FLUID RESISTANT ELECTRICAL DEVICE

[75] Inventors: Delbert R. Parker; Daren A. Clark, both of Centralia, Mo.

[73] Assignee: A. B. Chance Company, Centralia, Mo.

[21] Appl. No.: 800,718

[22] Filed: Nov. 22, 1985

[51] Int. Cl.[4] ..... H01H 85/14; H01H 85/04

[52] U.S. Cl. ..... 337/248; 337/158; 337/251; 228/136; 228/60; 29/623

[58] Field of Search ..... 337/248, 251, 252, 253, 337/254, 231, 232, 158; 174/52 S, 75 R; 338/271, 272, 273, 274; 361/306; 29/623, 613, 619; 228/136, 154, 168, 60

[56] References Cited

U.S. PATENT DOCUMENTS 3,333,336 8/1967 Cameron et al. ..... 337/231

4,146,862 3/1979 Mikulecky ..... 337/158

*Primary Examiner*—Harold Broome

*Attorney, Agent, or Firm*—Schmidt, Johnson Hovey & Williams

[57] ABSTRACT

An end cap assembly for a fluid resistant electrical device includes a solderable insulating tube end cap and an insert having a solderable cylindrical body portion positioned within a tubular opening of the end cap. The body portion of the insert has a circumscribing groove containing a quantity of solder. During assembly, the walls of the end cap defining the tubular opening are magneformed inwardly to tightly engage the body portion and thus provide limited frictional resistance to movement of the insert relative to the end cap. Next, the end cap and insert are heated until the solder melts. The end cap assembly provides a strong, torque resistant connection between the insert and the end cap while also maintaining a highly effective seal to preclude fluid leakage when the device is immersed.

17 Claims, 6 Drawing Figures

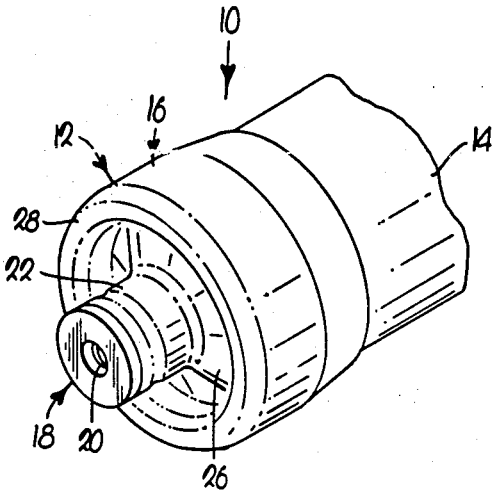
Fig. 1
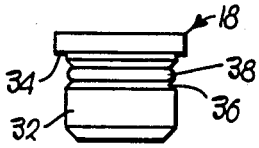
Fig. 3
Fig. 2
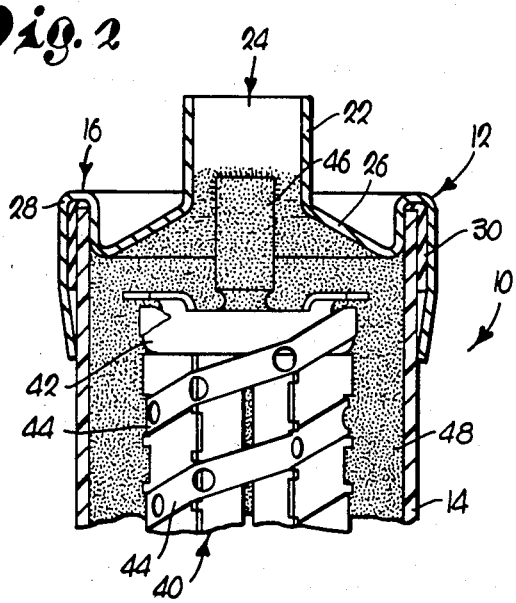
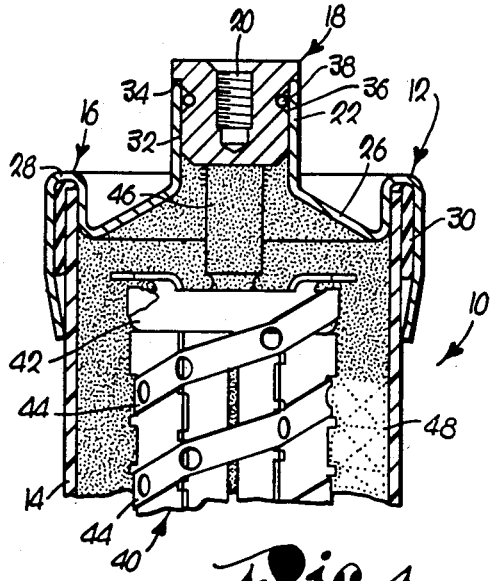
Fig. 4
Fig. 5
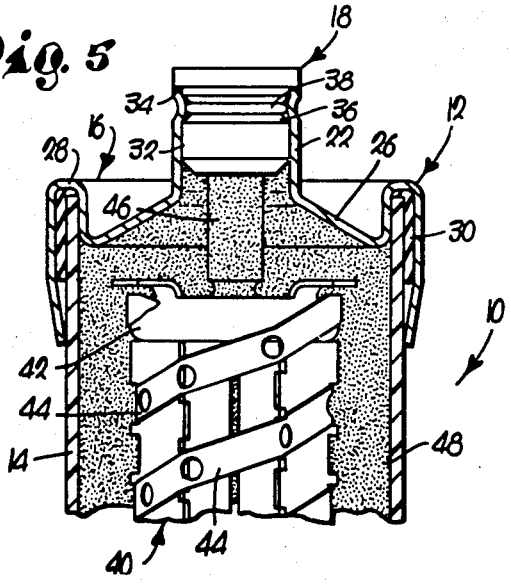
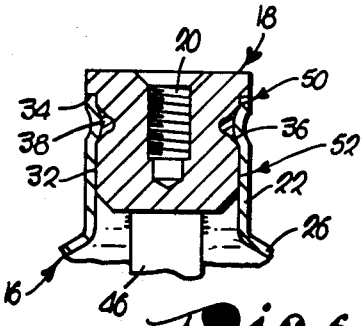
Fig. 6

END CAP ASSEMBLY FOR A FLUID RESISTANT ELECTRICAL DEVICE

BACKGROUND OF THE INVENTION

1. Field of the Invention

This invention relates to an end cap assembly for a fluid resistant electrical device, wherein the assembly includes an insulating tube end cap and a grooved, cylindrical insert or plug which is securely positioned within a tubular opening of the end cap.

2. Description of the Prior Art

Fluid resistant electrical devices are widely utilized in various applications. As an example, oil immersible current limiting fuses are used in combination with expulsion fuses for protection of high voltage primary circuit components such as distribution transformers. The current limiting fuse has an element which is designed to rupture and interrupt the circuit upon the occurrence of a relatively high current, primary fault, while the expulsion fuse, in contrast, provides protection against lower amperage overload currents.

Expulsion fuses or switchgear are often immersed in insulating transformer oil and thus, in order to save space and eliminate the use of drywell canisters, it is preferable to also mount the series wired current limiting fuse within the same oil filled tank. Consequently, the fuse must be completely sealed to resist oil infiltration over the life of the fuse regardless of any stresses imposed upon the fuse body during installation or subsequent use.

One known type of current limiting fuse has an end cap assembly which includes a threaded bore for electrical coupling of the fusible element to the circuit to be protected. During installation, the bolt is inserted through a terminal lug coupled to a lead of the circuit, and the bolt is then threaded into the bore in the fuse end cap assembly and sufficiently tightened to reduce the possibility of loosening, since a loose connection in a high voltage circuit can lead to hazardous, violent arcing. As can be appreciated, an electrician might apply relatively large amounts of torque stress to the fuse end cap assembly in an effort to insure that such loosening of the lug bolt does not occur. Unfortunately, such stresses may break the seal of the fuse and thus the oil resistant sealing capability can be unknowingly destroyed.

Moreover, during manufacture of the fuse, it is desirable to insert a quantity of gas within the fuse tube before sealing of the same so that the gas can later serve as a leakage indicator during subsequent testing. Consequently, it is important to assemble and seal the fuse quickly after insertion of the gas to provide a valid leak test.

In the past, certain current limiting fuses have been provided with an end cap assembly having a fuse tube end cap with outwardly-extending walls defining a tubular opening. The assembly also includes a cylindrical insert with a circumscribing groove and a shoulder adjacent the groove, and the shoulder is engageable with the outward end of the end cap walls defining the tubular opening as the insert is positioned partially within the opening. A quantity of solder adheres to both the insert and the walls of the opening. However, such construction can provide only a limited resistance to torque stress during installation of the fuse.

A lightning arrestor is another example of an electrical device that should resist entry of fluids over its field life. The arrestor, when mounted in an outdoor environment, should be constructed to prevent entry of rainwater and thereby protect internal electrical subassemblies. Alternatively, an arrestor immersed in insulating oil should be provided with means for substantially precluding the entry of oil.

Accordingly, it would be a desirable advance in the art to provide an electrical device end cap assembly which permits simple and rapid assembly during manufacture, while providing a highly effective fluid resistant seal that retains its integrity even when a relatively high torque is applied to the end cap during installation.

SUMMARY OF THE INVENTION

The present invention represents a significant advance in the art by provision of a novel end cap assembly having the combination of an insulating tube end cap and a generally cylindrical, shouldered insert, wherein the insert has a circumscribing groove spaced from the shoulder and disposed around a reduced diameter, cylindrical body portion of the insert. When the body portion is placed within a complementally shaped tubular opening of the end cap, the walls defining the tubular opening are located directly opposite and also to each side of the groove, for purposes to be explained hereinafter.

During assembly, a quantity of solder is placed around the groove in the body portion and the latter is then positioned within the tubular opening of the end cap. Next, the walls of the tubular opening are magneformed to pressingly engage the body portion of the insert and thereby serve as a holding fixture to provide limited frictional resistance to relative movement between the insert and the end cap. Finally, the solder, the insert and the end cap are heated until the solder melts.

It has been found that the end cap assembly after manufacture is highly resistant to installation torque stresses because of the soldered connection between the end cap and the insert, in cooperation with the magneformed, complemental fit of the opening-defining walls relative to the body portion of the insert. Also, the fact that the walls are disposed to each side of the groove enables the solder to be drawn by capillary action along two opposite axially-oriented directions such that a pair of highly torque resistant mechanical connections as well as two fluid-sealing areas are established.

A quantity of helium gas can preferably be injected into the insulating tube immediately before the insert is placed within the tubular opening. Subsequently, the positioning of the insert within the tubular opening, as well as the magneforming and soldering of the body portion can quickly occur without excessive loss of helium. A mass spectrometer may then be used to detect leakage of helium and thereby indicate a defectively sealed assembly.

Advantageously, a conductive tab that is coupled to an internal subassembly within the device is brazed to a portion of the end cap, and the brazing operation may be performed using internal access that is provided through the end cap tubular opening before insertion of the body portion. Subsequently, the insert is positioned within the opening and the end cap as well as the insert can be heated to melt the solder without adversely affecting the integrity of the brazed connection between the tab and the end cap. At the same time, the end cap assembly after manufacture is highly resistant to installation torque stresses because of the soldered connection between the insert and the end cap, in cooperation with the magneformed, complemental fit of the walls defining the tubular opening to the body portion of the insert.

BRIEF DESCRIPTION OF THE DRAWINGS

FIG. 1 is a fragmentary, perspective view of a current limiting fuse having an end cap assembly constructed in accordance with the principles of the present invention;

FIG. 2 is a fragmentary, enlarged, cross-sectional view of the fuse shown in FIG. 1, wherein a support assembly and fusible element are positioned within the fuse and a tab is brazed to an end cap of the end cap assembly before the insert is placed within the tubular opening of the end cap;

FIG. 3 is a side elevational view of the insert of the end cap assembly of FIG. 1;

FIG. 4 is a fragmentary, enlarged cross-sectional view similar to FIG. 2 depicting the positioning of the insert within the tubular opening after the brazing operation is completed;

FIG. 5 is a fragmentary, enlarged cross-sectional view similar to FIG. 4, illustrating the configuration of the walls defining the tubular opening of the end cap after the walls are magneformed to tightly engage the insert; and FIG. 6 is an enlarged, fragmentary, cross-sectional view of the end cap and insert as shown in FIG. 5 wherein the insert and end cap have been heated until the melting temperature of the solder is reached.

DETAILED DESCRIPTION OF THE DRAWINGS

With reference to FIG. 1, and as an example of the principles of the present invention, a high voltage, oil immersible, current limiting fuse structure 10 includes an end cap assembly 12 that is secured to one end of a generally cylindrical fuse insulating tube 14. The end cap assembly 12 comprises an end cap 16 engageable with the fuse tube 14 and the assembly 12 also includes an insert 18 which has an internally threaded bore 20 for connection with a bolt (not shown) and a terminal lug (also not shown) which forms a part of the electrical circuit to be protected by the fuse 10.

Viewing FIG. 2, the end cap 16 has walls 22 defining a centrally disposed, generally cylindrical tubular opening 24. The end cap 16 also has an outwardly extending, inclined central portion 26 and a transversely U-shaped rim 28 which engages the end of the fuse tube 14. A sealing means 30 is located within the rim 28 and engages the portion of the fuse tube 14 to preclude leakage of oil in the area adjacent the end of the tube 14.

Referring now to FIG. 4, the generally cylindrical insert 18 has a reduced diameter body portion 32 positioned within the tubular opening 24 of the end cap 16. The insert 18 has a shoulder 34 adjacent the body portion 32 for engagement with an outer edge of the walls 22 defining the tubular opening 24. The body portion 32 is circumscribed with a peripheral groove 36 which is adjacent the walls 22 defining the opening 24.

The end cap assembly 12 also includes a quantity of solder 38 that is located within the groove 36 and adheres to a portion of the walls 22 of the end cap 16 as well as the body portion 32, as best seen in FIG. 6. The walls 2 defining the opening 24 are advantageously magneformed for complemental, mating and pressing contact with the adjacent body portion 32.

As illustrated in FIGS. 2 and 4–5, the fuse 10 also includes an internal support assembly 40 which has a terminal bracket 42 on one end thereof. An internal subassembly includes a pair of fusible elements 44 which are wrapped around the support assembly 40 and secured in a parallel wiring arrangement to the bracket 42. A tab 46 of the bracket 42 extends outwardly and is brazed to a portion of the wall 22 of the end cap 16. Finally, a quantity of sand 48 is placed within the fuse tube 14 to preclude lateral movement of the support assembly 40 as well as to provide an insulating means for current should a relatively large overload rupture the elements 44.

In the method of preparing an end cap assembly 12 for the current limiting fuse 10, the support assembly 40 having the fusible elements 44 is positioned within the fuse tube 14, and the end cap 16 is then secured to the tube 14 along with the sealing means 30. Next, the tab 46 is brazed to an internal portion of the walls 22 defining the tubular opening 24, as shown in FIG. 2.

The solder 38 is then wrapped around the groove 36 in the insert 18 as shown in FIG. 3. Subsequently, the outer surfaces of the body portion 32 of the insert 18 are provided with an appropriate quantity of flux. The insert 18 is then placed within the opening 24 to a location wherein the shoulder 34 of the insert 18 engages the outer edge of the walls 22. It is noteworthy that the shoulder 34 thus is operable as an alignment means to align the insert 18 relative to the end cap 16. Additionally, the shoulder 34 provides a stop to limit the extent of movement of the insert 18 within the opening 24.

In a particularly preferred method in accordance with the instant invention, before placement of the insert 18 within the opening 24, the air from the interior of the fuse 10 is evacuated and a quantity of helium is placed therein to a pressure of about 1 atmosphere. Desirably, the insert 18 is then rapidly positioned within the opening 24 before substantial loss of helium from the interior of the fuse 10 occurs. However, because the helium within the tube 14 is not pressurized to a degree substantially greater than the surrounding atmosphere, loss of helium will occur only by means of a relatively slow diffusion process through the opening 24.

In the next step of assembly as depicted in FIG. 5, the walls 22 are shaped by a magneforming operation such that a portion of the walls 22 adjacent the groove 36 assume a concave configuration and engage the solder 38. The magneforming process provides electromagnetic forces in the walls 22 to literally shrink the walls 22 inwardly without appreciable formation of wrinkles. Consequently, reasonable manufacturing tolerances may be utilized in the construction of the insert 18 and the walls 22, since the subsequent magneforming operation effectively eliminates slack. Moreover, the magneforming operation can be accomplished quickly to thereby provide limited frictional resistance to relative movement between the insert 18 and the cap 16 so that the insert 18 remains stationary and substantially obstructs passage of helium from the interior of the fuse 10.

Next, as shown in FIG. 6 ,the insert 18, the end cap 16 as well as the solder 38 is heated until the melting temperature of the solder 38 is reached. As the solder 38 melts, the latter substantially fills the groove 36 and also is drawn laterally in oppositely-oriented axial directions by capillary action to adhere to other areas of the body portion 32 and the adjacent walls 22. It has been found that best results are obtained by soldering with resistance heating utilizing, in part, a pair of spaced, yoke-shaped electrodes engageable on opposite external areas of the walls 22.

The orientation of the groove 36 laterally between the portions of the walls 22 enables the latter to contact the body portion 32 in two separate areas designated 50, 52 (FIG. 6) to each side of the groove. Thus, during assembly, the solder 38 is drawn in two opposite directions to establish an oil-resistant seal as well as a mechanical connection in both of the areas 50, 52. Such construction substantially precludes leakage or accidental loosening should the solder 38 fail to wick sufficiently for establishment of an uninterrupted, circumscribing band of solder 38 in either of the areas 50, 52.

However, as can now be appreciated by one skilled in the art, use of the insert 18 in cooperation with the end cap 16 enables access to the interior portions of the fuse 10 so that the tab 46 can be initially brazed to the cap 16. However, it is noteworthy that subsequent soldering of the insert 18 to the walls 22 does not adversely affect the brazed joint, because the latter is typically formed at a temperature greater than 600° F. while the soldering operation is carried out at temperatures of 400° F.

As a result, the end cap assembly 12 of the instant invention provides a strong, leak-resistant connection between the insert 18 and the end cap 16 that can withstand substantial amounts of torsional stress during the installation of the fuse 10 in a high voltage circuit to be protected. Thus, a bolt that is connected to a terminal lug and inserted into the bore 20 and be greatly tightened without fear of loosening the connection between the cap 16 and the insert 18 and consequently breaking the oil seal. Moreover, the oil seal between the cap 16 and the insert 18 remains unaffected by thermal cycling excursions which commonly occur during use.

Although not shown, the end cap assembly 12 is also suitable for use with lightning arrestor structure that is exposed to fluid such as rainwater or insulating oil. As is similar to fuse construction, the end cap assembly 12 when used with arrestor structure provides an electrically conductive joint that is of a strength sufficient to withstand severe torsional stresses during installation. The assembly 12 also substantially precludes fluid leakage into internal portions of the arrestor to thereby ensure that the useful life of the device is not unnecessarily shortened.

What is claimed is:

1. In an end cap assembly for a fluid resistant electrical device, the combination of:

an end cap engageable with an insulating tube and having solderable walls defining a tubular opening;

an insert having a solderable body portion positioned within said tubular opening of said end cap, said walls defining said tubular opening being formed for complemental, mating contact with said body portion such that mechanical interference is provided to limit movement of said insert relative to said end cap during assembly, said body portion having a peripheral groove adjacent said walls defining said opening, said walls being disposed to each side of said groove; and a quantity of solder located within said groove and adhering to at least a portion of said walls and said body portion to preclude movement of said insert relative to said end cap.

2. The invention of claim 1, wherein said body portion is generally cylindrical.

3. The invention of claim 2, wherein said walls defining said tubular opening are magneformed for complemental, mating contact with said body portion.

4. The invention of claim 3; including a means for aligning said insert to said end cap.

5. The invention of claim 4, wherein said alignment means comprises a shoulder on said insert adjacent said body portion for engagement with an outer edge of said walls defining said tubular opening.

6. The invention of claim 5, wherein said groove is spaced from said shoulder.

7. The invention of claim 1, wherein said insert is provided with a threaded bore for engagement with a bolt having a wire lead means coupled thereto.

8. The invention of claim 2, wherein said groove circumscribes said body portion.

9. The invention of claim 1, wherein said walls defining said tubular opening are engageable with a tab electrically connected to an internal subassembly.

10. A method of preparing an end cap assembly for a fluid resistant electrical device comprising the steps of:

placing a quantity of solder in a peripheral groove of a solderable insert;

positioning said insert at least partially within a tubular opening of a solderable end cap such that said solder is adjacent the walls of said end cap defining said opening;

causing a portion of the walls defining said opening to pressingly engage said insert and thereby provide mechanical interference to limit relative movement between said insert and said end cap; and heating said solder, said insert and said end cap until said solder melts.

11. The method of claim 10, wherein said step of causing a portion of the walls defining said opening to pressingly engage said insert comprises a magneforming operation.

12. The invention of claim 11, wherein said magneforming operation causes said portion of said walls to be directed inwardly of said opening in the area of said insert surrounding said groove.

13. The method of claim 10, wherein said step of heating said solder, said insert and said end cap utilizes, in part, a pair of yoke-shaped heating means engageable with said walls of said end cap defining said tubular opening.

14. The method of claim 13, wherein said heating means comprises electrical resistance heaters.

15. A method of assembling a fluid resistant electrical device comprising the steps of:

coupling a solderable end cap to one end of an insulating tube;

connecting one end of a fusible element positioned within said tube to said end cap;

placing a quantity of solder in a peripheral groove of a solderable insert;

positioning said insert at least partially within a tubular opening of said end cap such that said solder is adjacent the walls of said end cap defining said opening;

causing a portion of the walls defining said opening to pressingly engage said insert and thereby provide limited frictional resistance to movement between said insert and said end cap; and heating said solder, said insert and said end cap until said solder melts.

16. The method of claim 15, wherein said step of connecting said element to said end cap comprises a brazing operation.

17. The method of claim 15; and including the step of injecting a quantity of gas within said insulating tube for detection of any leakage pathways.

* * * * *